United States Patent [19]

Cunningham et al.

[11] 4,061,238

[45] Dec. 6, 1977

[54] LOAD CARRYING FORK FOR AN INDUSTRIAL VEHICLE

[75] Inventors: William L. Cunningham; Duane W. Graham, both of Portland, Oreg.

[73] Assignee: Hyster Company, Portland, Oreg.

[21] Appl. No.: 633,828

[22] Filed: Nov. 20, 1975

[51] Int. Cl.[2] ..... B66F 9/14

[52] U.S. Cl. ..... 214/750; 214/731

[58] Field of Search ..... 214/750, 730–731, 214/620, 768, 660, 670–674, 103–109

[56] References Cited

U.S. PATENT DOCUMENTS 3,982,647 9/1976 Teutsch ..... 214/750

*Primary Examiner*—Robert J. Spar
*Assistant Examiner*—R. B. Johnson
*Attorney, Agent, or Firm*—Francis L. Swanson

[57] ABSTRACT

A load carrying fork for use with an industrial truck is disclosed. The fork is of generally L-shaped configuration and has a thickened tapered outside heel section. The inside intersect of the vertical and horizontal shank of the fork defines an undercut of relatively large radius. The longitudinal axis of the undercut, which is transverse to the longitudinal axis of the vertical and horizontal shanks, is slightly concave.

1 Claim, 4 Drawing Figures

LOAD CARRYING FORK FOR AN INDUSTRIAL VEHICLE

BACKGROUND OF THE INVENTION

1. Field of the Invention

The invention is directed to load carrying members for industrial lift trucks and more particularly to fork type load arms having an L-shaped configuration.

2. Description of the Prior Art

Load supporting forks of generally L-shaped configuration for use with industrial lift trucks are well known in the prior art and have been used for many years. They are commonly manufactured in one of two ways; smaller forks are simply bent into an L-shaped configuration. Large forks having thick cross sections are made by simply welding the vertical shank to the horizontal shank. In all common constructions the horizontal shank tapers from the heel to a slender tip to facilitate insertion of the fork into pallets or under loads. A typical example of pin-type fork construction is illustrated in a U.S. Pat. No. 3,851,779.

SUMMARY OF THE INVENTION

The principal object of the present invention is to provide a load fork design having means for substantially reducing the stresses in the fork heel without impairing its load carrying ability.

A further object of the invention is to provide a fork construction having means for redistributing the stress gradient within the fork heel.

A further object of the present invention is to provide a load fork construction of composite design wherein the heel is a high strength steel casting or forging and the vertical and horizontal shank are made of steel bar welded to the heel.

Additional features and advantages of the invention will be apparent to those skilled in the art from examination of the accompanying specification and drawing wherein.

DETAILED DESCRIPTION

BACKGROUND

The typical lift truck fork as known in the prior art will have a uniform cross section throughout both the vertical and horizontal shanks in the area adjacent the 90° bend, commonly known as the heel. The inside radius of the heel, regardless of whether produced by bending or welding, is usually very small. This small radius will tend to act as a stress raiser in forks that are heavily loaded. Since most forks are heat treated to increase their strength, minute cracks which may result from such heat treatment will act as stress raisers also. In welded forks, pockets, craters, cracks, slag or inclusions in the weld metal which joins the vertical and horizontal shanks at the heel will also act as points of stress concentration.

Stress studies of the typical prior art fork by the inventors reveal that a small inside radius Ri in the fork heel will induce intense stress concentration in the radius itself and in the areas immediately adjacent the radius on the tensile side of the centroidal axis. Presence of a small radius will also cause a shift in the neutral axis toward the tensile side of the construction and away from the centroidal axis. The greater the stress concentration the closer the neutral axis is to the tensile surface and the steeper the stress gradients are from the tensile surface to the neutral axis. This neutral axis shift can have a significant effect if cracks or other abnormalities are present as these will reduce an already small tensile working area. Stress studies also reveal that stress level gradients in the radius tend to be very steep if the surface of the radius tends to be convex in a direction transverse to the longitudinal axis of the vertical and horizontal shanks.

THE PREFERRED EMBODIMENT

Figure 3:
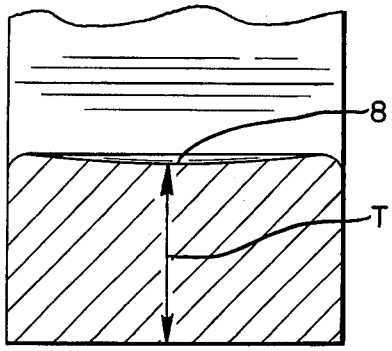
FIG. 3 is a sectional view taken along line 3—3 of FIG. 2.
Figure 1:
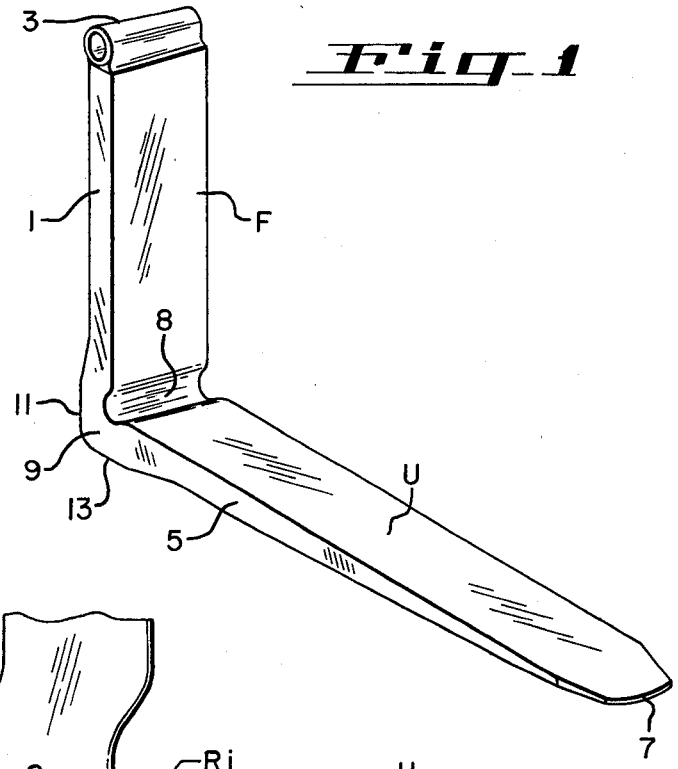
FIG. 1 is a perspective view showing the preferred construction of the fork.
Figure 2:
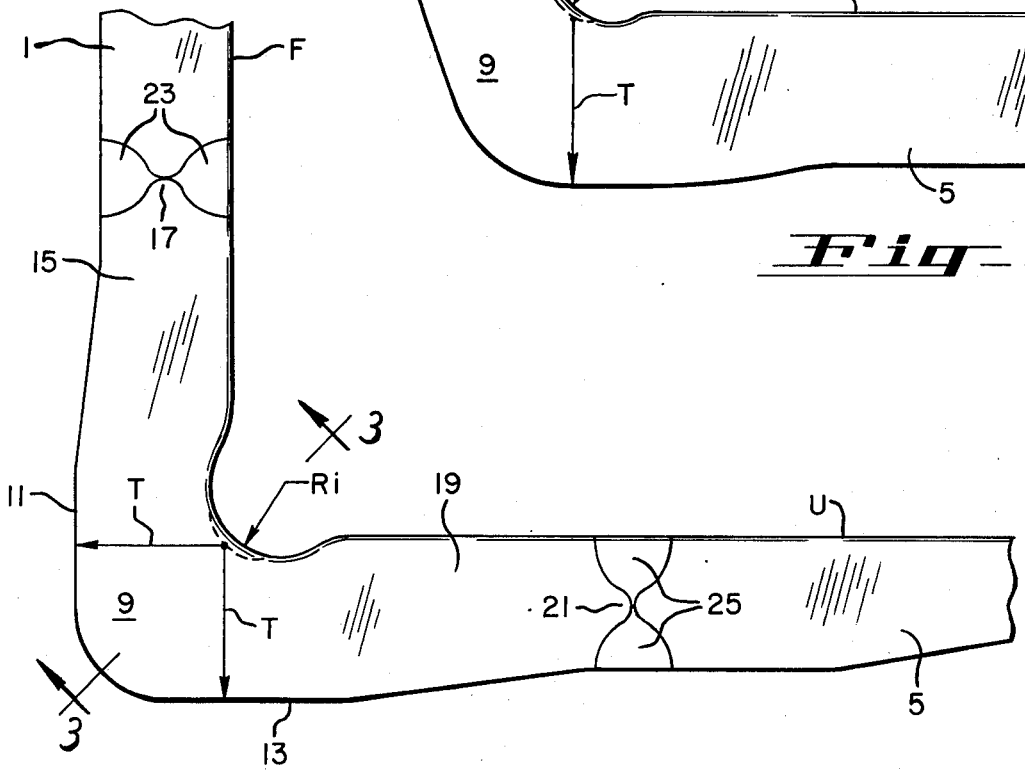
FIG. 2 is a profile of the preferred embodiment showing a composite construction using a high strength casting or forging for the heel which is welded to the vertical and horizontal shanks.

Referring now to FIG. 1 the fork consists of a vertical shank 1 having at its upper end a hollow tube member 3 which provides means for attaching the fork to an industrial truck carriage (not shown). The load fork has a horizontal shank 5 which tapers to a narrow tip 7. The intersect of vertical shank 1 and horizontal shank 5 form the heel 9 of the fork. FIG. 2 shows the heel of the present invention in greater detail. In contrast to the prior art construction the inside radius Ri of heel 9 is large; potentially 1 to 2 inches. Radius Ri defines a transverse groove 8 at the intersect of shanks 1 and 5. This groove undercuts both the front surface F of vertical shank 1 and the upper surface U of horizontal shank 5; surface F and U being the load engaging surfaces of the fork. Transverse groove 8 is concave along its longitudinal axis as shown in FIG. 3. The surface defined by groove 8 is thus compound in curvature. This has the effect of redistributing the stress gradients in the radius and the areas adjacent thereto and forces the edges of shanks 1 and 5 to carry a greater share of the distributed load. This concavity of groove 8 along its longitudinal axis is not pronounced. Therefore, as used here, radius Ri which defines groove 8 is understood to mean the radius of curvature measured at any point along the longitudinal axis of groove 8 normal to said axis. It is immediately apparent that the disclosed fork could be manufactured so that the transverse groove 8 would define a surface purely cylindrical along the longitudinal axis of groove 8.

The heel section thickness T as shown in FIGS. 2 & 3 is of significance in the invention. T is measured from the deepest point of undercut of transverse groove 8 along a line parallel to the longitudinal axis of vertical shank 1 to the bottom surface 13 of horizontal shank 5.

Section thickness T is thus the perpendicular distance from the bottom of the heel 9 to the groove 8. Heel section T is related to radius Ri in the construction as follows:

The size of radius Ri is chosen so that the ratio of Ri to the heel section thickness T as shown in FIGS. 2 & 3 falls between 0.25 and 1.0. Expressed mathematically: $0.25 \leqq Ri/T \leqq 1.0$.

The result of maintaining the ratio Ri/T within the limits stated above is that, for a given load, stresses in the heel 9 are significantly lowered. It follows that a fork of the disclosed construction will support a load equal to or slightly larger than a conventional fork with a small inside radius and thicker heel section. A significant reduction in stresses is thus achieved without impairing the load carrying capacity of the fork.

The heel section configuration which results from maintaining the ratio Ri/T in the range of 0.25 to 1.0 is such that the vertical rear surface 11 and the horizontal bottom surface 13 of the heel does not lie in the same plane as the rear surface of the vertical shank 1 and the bottom surface 13 of horizontal shank 5 respectively. Surfaces 11 and 13 therefore are tapered to blend gradually into shanks 1 and 5.

In accordance with the composite construction shown in FIG. 2, heel 9 is a high strength steel casting or forging having a tapered vertical shank 15 terminating in a narrow projection 17 and further having a tapered horizontal projection 19 terminating the narrow projection 21. Projections 17 and 21 facilitate the formation of weld joints 23 and 25 in the manufacture of the embodiment shown in FIG. 2. The heel 9 is welded to vertical shank 1 and horizontal shank 5 at weldment 23 and 25 respectively. This alternative construction allows precise control over the configuration of heel 9 since it is a casting or forging.

Figure 4:
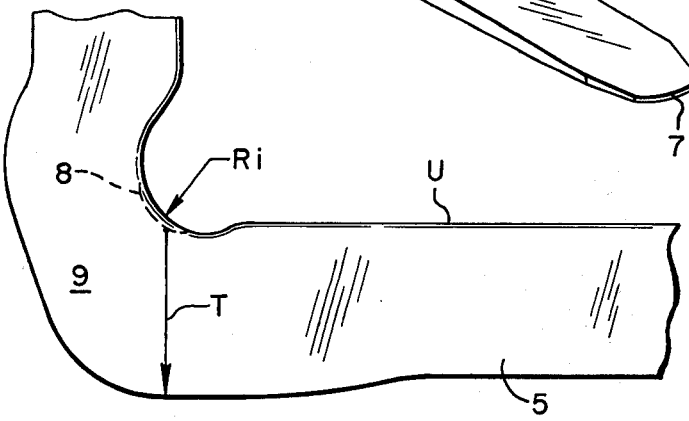
FIG. 4 is a profile of an alternative configuration of the heel of the fork.

Having described the preferred embodiment of the invention it will be apparent to those skilled in the art that various other forms thereof can be provided without departing from the true spirit and scope of the invention. One such variation is shown in FIG. 4. We claim in our invention all such variations as fall within the scope of the appended claims.

What is claimed is:

1. A load carrying fork for use with an industrial vehicle comprising:

an L shaped member having a vertical shank and a horizontal shank, said shanks each having load engaging surfaces;

means on the upper end of the vertical shank for attaching the fork to the vehicle;

a generally cylindrical groove extending transverse to the longitudinal central axis of the horizontal shank and located at the intersect of the vertical and horizontal shanks, the groove having a first end, a second end and a center, the groove further having a longitudinal central axis defined by a straight line, said groove central axis being normal to the longitudinal central axis to the horizontal shank, the groove defining an undercut below the load engaging surfaces of the vertical and horizontal shanks, said intersect further defining the heel of the fork;

the perpendicular distance from the bottom of the horizontal shank to the surface of said center of said groove defining the thickness of said heel, the radius of curvature of said groove at said center being greater than at said first and second end of said cylindrical groove;

and the ratio of the radius of curvature of the groove at the groove center to the heel thickness having a value in the range substantially from 0.25 to 1.0 so that stresses in the intersect are reduced.

* * * * *